US005431591A

United States Patent [19]

Muzzi

[11] Patent Number: 5,431,591

[45] Date of Patent: Jul. 11, 1995

[54] HELICAL SPRING PRESSURE ACTIVATED MUSICAL TOY

[76] Inventor: Juan Carlos C. Muzzi, Calle 25 EQS. Goruero, Punte De Este, Maldonado, Uruguay

[21] Appl. No.: 190,784

[22] Filed: Feb. 1, 1994

[51] Int. Cl.[6] ..... A63H 5/00

[52] U.S. Cl. ..... 446/397; 446/408; 446/486; 84/723

[58] Field of Search ..... 446/176, 213, 397, 486, 446/491, 297, 299, 302, 404, 408, 487, 484, 188, 196, 81; 84/723, 734, 735, 737, 600, DIG. 24; 482/74, 84, 900

[56] References Cited

U.S. PATENT DOCUMENTS

| | | | |
|---|---|---|---|
| 1,698,142 | 1/1929 | Petrov | 446/196 |
| 1,883,724 | 10/1932 | Grubman | 446/196 |
| 2,479,790 | 8/1949 | Strumor | 446/302 |
| 3,002,318 | 10/1961 | Carver | 446/188 |
| 3,048,072 | 8/1962 | Hanert | 84/DIG. 26 |
| 3,587,006 | 6/1971 | Weingartner et al. | 84/737 |
| 3,691,675 | 9/1972 | Rodgers | 446/188 |
| 3,719,908 | 3/1973 | Fidi | 84/737 |
| 3,938,063 | 2/1976 | Meinema | 84/737 |
| 4,264,883 | 4/1981 | Honda | 84/737 |
| 4,491,050 | 1/1985 | Franzmann | 84/DIG. 25 |
| 4,587,877 | 5/1986 | Zacharias | 84/DIG. 24 |
| 4,744,279 | 5/1988 | Livingston | 84/DIG. 24 |
| 4,904,222 | 2/1990 | Gastegeb et al. | 446/473 |
| 4,920,848 | 5/1990 | Suzuki | 84/600 |
| 4,977,811 | 12/1990 | Suzuki et al. | 84/600 |

FOREIGN PATENT DOCUMENTS

| | | | |
|---|---|---|---|
| 2014865 | 10/1978 | Germany | 84/723 |
| 2916189 | 11/1979 | Germany | 84/734 |
| 10663 | of 1916 | United Kingdom | 446/188 |

*Primary Examiner*—Robert A. Hafer
*Assistant Examiner*—Jeffrey D. Carlson
*Attorney, Agent, or Firm*—Kane, Dalsimer, Sullivan, Kurucz, Levy, Eisele and Richard

[57] ABSTRACT

An educational and amusement device for the development of a sense of rhythm with eye and hand coordination is described. An embodiment device combines the action of a helical spring with a pressure-actuated tone generator, annunciated through a transducer in the form of a musical melody.

1 Claim, 1 Drawing Sheet

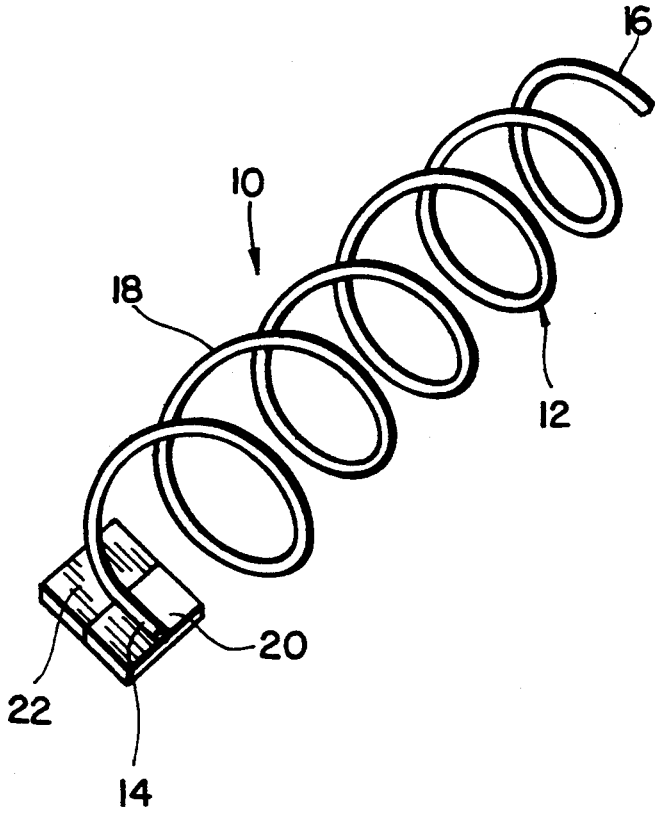
16
10
18
12
20
22
14

HELICAL SPRING PRESSURE ACTIVATED MUSICAL TOY

BACKGROUND OF THE INVENTION

FIELD OF THE INVENTION

The invention relates to devices for education and amusement and more particularly to a musical toy.

SUMMARY OF THE INVENTION

The invention comprises a musical toy, which comprises;

a helical spring having a first end and a second end with a spirally wound elongate member extending between the first and second ends; and a pressure-activated tone generator attached to an end of the spring.

The musical toy of the invention is an amusement and educational device for development of a sense of rhythm with hand and eye coordination.

BRIEF DESCRIPTION OF THE DRAWING

The accompanying drawing is a view-in-perspective of an embodiment toy of the invention.

DETAILED DESCRIPTION OF THE PREFERRED EMBODIMENTS OF THE INVENTION

With reference to the accompanying drawing, an embodiment toy 10 of the invention is shown as consisting of a spirally wound spring 12 having a first end 14 and a second end 16 with an elongate member body 18 between the ends 14, 16. Advantageously the spring 12 has low resistance to compression and stretching, so that a child of tender years can compress and stretch the spring 12 without difficulty. Varied spring resistances can be employed when desired for the purpose of affording muscle exercise and development for the operator of the device. The spring 12 may be manufactured from a wide variety of materials, including metals such as steel and the like or synthetic polymeric resins such as extrusions of polycarbonate, polyurethane, polyamides, polyaramids and the like. Combinations of materials may also be used, for example metal wires coated with synthetic polymeric resins. Advantageously, the spring 12 is fabricated in one or more colors so that when operated as hereinafter described, they will provide visual stimulation to the operator.

As shown in the accompanying drawing, there is attached to one end 14 of the spring 12 a pressure-actuated tone generator 20 connected to an audio transducer 22. The tone generator 20 can, upon activation, provide musical notes, annunciated through transducer 22, which is electrically connected to the tone generator. The tone generator 20 can be one which selectively activates under varying, different pressures to play different or a plurality of notes, so that different pressures by manual application give musical notes of different scale. A melody could be played by varying hand pressure on the tone generator 20 control. This can give a training of ear and hand together.

The toy 10 is operated as follows:

the operator grasps end 14 of spring 12 with one hand and end 16 with a second hand. The spring 12 is compressed or stretched manually between the hands. Hand pressure on the end 14 actuates the tone generator 20 so that a musical tune is played. Any tune may be played, but is appropriately selected so that the operator may appreciate the musical rhythm in the tune played and attempt to coordinate hand movements in manual exercise of the spring 12. When the spring 12 is colored, especially multi-colored, the visual stimulation functions to aid in eye-hand coordination with the sense of rhythm.

Those skilled in the art will appreciate that many modifications of the above-described preferred embodiment toy 10 may be made without departing from the spirit and the scope of the invention. For example, tone generators 20 may be mounted on both ends 14, 16 of spring 12 with associated audio transducers 22.

What is claimed:

1. A musical toy which comprises;

a helical spring which is multicolored and fabricated from a synthetic polymeric resin having a first end and a second end with a spirally wound elongate member extending between the first and second ends; the said ends adapted to be moved toward and away from each other a pressure-activated tone generator attached to the first end of the spring; the second end being free and adapted to be grasped by a user and an audio transducer electrically connected to the tone generator whereby when the spring si selectively compressed and released, a plurality of musical notes are played.

* * * * *